US008995897B2

(12) United States Patent
Coggan et al.

(10) Patent No.: US 8,995,897 B2
(45) Date of Patent: Mar. 31, 2015

(54) FUSER MEMBER

(71) Applicant: Xerox Corporation, Norwalk, CT (US)

(72) Inventors: Jennifer A. Coggan, Kitchener (CA); Yu Qi, Oakville (CA)

(73) Assignee: Xerox Corporation, Norwalk, CT (US)

( * ) Notice: Subject to any disclaimer, the term of this patent is extended or adjusted under 35 U.S.C. 154(b) by 127 days.

(21) Appl. No.: 13/850,663

(22) Filed: Mar. 26, 2013

(65) Prior Publication Data

US 2014/0294470 A1 Oct. 2, 2014

(51) Int. Cl.
*G03G 15/20* (2006.01)

(52) U.S. Cl.
CPC ..... *G03G 15/206* (2013.01)
USPC ..... 399/333; 430/124.32

(58) Field of Classification Search
USPC ..... 399/333, 330, 328, 329; 430/124.3, 430/124.32, 124.33
See application file for complete search history.

(56) References Cited

U.S. PATENT DOCUMENTS

| | | | | |
|---|---|---|---|---|
| 6,927,006 | B2 * | 8/2005 | Finn et al. | 399/333 X |
| 7,214,423 | B2 | 5/2007 | Finn et al. | |
| 8,135,324 | B2 | 3/2012 | Moorlag | |
| 2008/0070031 | A1 * | 3/2008 | Rasch et al. | 399/333 X |
| 2011/0183265 | A1 * | 7/2011 | Kim et al. | 430/296 |
| 2012/0070208 | A1 * | 3/2012 | Qi et al. | 399/333 |

OTHER PUBLICATIONS

Park et al., "Facile fabrication of superhydrophobic coatings with polyimide particles using a reactive electrospraying process", Journal of Materials Chemistry 2012, 22, 16005; published on Jun. 18, 2012.

* cited by examiner

*Primary Examiner* — Sophia S Chen
(74) *Attorney, Agent, or Firm* — Hoffman Warnick LLC

(57) ABSTRACT

There is disclosed a fuser member include a substrate layer and a release layer disposed on the substrate layer. The release layer includes a plurality polyimide particles dispersed in a fluoropolymer. An image forming apparatus equipped the fuser member is also described.

17 Claims, 4 Drawing Sheets

FUSER MEMBER

BACKGROUND

1. Field of Use

This disclosure is generally directed to release layers for fuser members useful in electrophotographic imaging apparatuses, including digital, image on image, and the like.

2. Background

Fuser roll topcoat materials are typically made from low surface-energy fluoropolymers including fluoroplastics and fluoroelastomers. The fluoropolymers provide heat and wear resistance, conformability and release at the fusing nip. However, short operating life of fuser members made of fluoroelastomers can occur. It would be desirable to increase the mechanical toughness and edge wear resistance of fluoroelastomer surface layers in fuser members.

A surface layer for a fuser member that has a low surface energy, durable and easily manufactured is desirable.

SUMMARY

According to an embodiment, there is provided a fuser member comprising a substrate layer and a release layer disposed on the substrate layer. The release layer includes a plurality of polyimide particles dispersed in a fluoropolymer.

According to another embodiment, there is provided an image forming apparatus for forming images on a recording medium. The image forming apparatus includes a charge-retentive surface for receiving an electrostatic latent image thereon and a development component to apply toner to the charge-retentive surface to develop the electrostatic latent image thereby forming a developed image on the charge-retentive surface. The image forming apparatus includes a transfer component to transfer the developed image from the charge retentive surface to a copy substrate. The image forming apparatus includes a fuser member for fusing toner images to a surface of the copy substrate. The fuser member includes a substrate, and disposed thereon, an outer layer comprising a plurality polyimide particles dispersed in a fluoropolymer.

According to another embodiment, there is provided a fuser member including a substrate, an intermediate layer disposed on the substrate and a release layer. The release layer is disposed on the intermediate layer. The release layer includes a plurality polyimide particles dispersed in a fluoropolymer.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
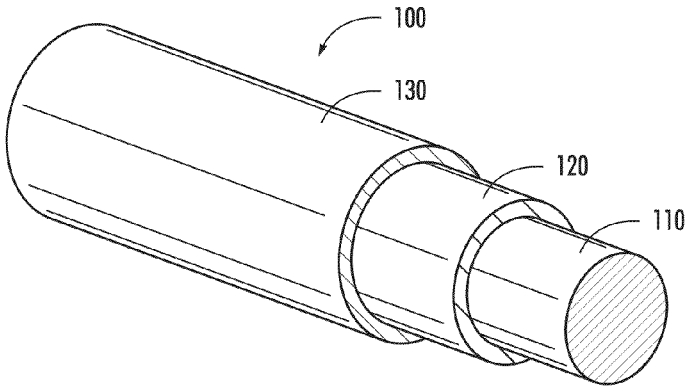
FIG. 1 depicts an exemplary fusing member having a cylindrical substrate in accordance with the present teachings.

It should be noted that some details of the FIGS. have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Illustrations with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

In various embodiments, the fixing member can include, for example, a substrate, with one or more functional layers formed thereon. The substrate can be formed in various shapes, e.g., a cylinder (e.g., a cylinder tube), a cylindrical drum, a belt, or a film, using suitable materials that are non-conductive or conductive depending on a specific configuration, for example, as shown in FIGS. 1 and 2.

Figure 2:
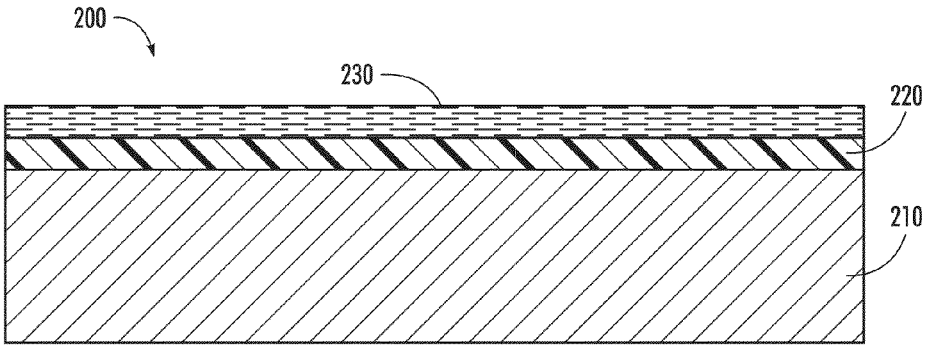
FIG. 2 depicts an exemplary fusing member having a belt substrate in accordance with the present teachings.

Specifically, FIG. 1 depicts an exemplary fixing or fusing member 100 having a cylindrical substrate 110 and FIG. 2 depicts another exemplary fixing or fusing member 200 having a belt substrate 210 in accordance with the present teachings. It should be readily apparent to one of ordinary skill in the art that the fixing or fusing member 100 depicted in FIG. 1 and the fixing or fusing member 200 depicted in FIG. 2 represent generalized schematic illustrations and that other layers/substrates can be added or existing layers/substrates can be removed or modified.

In FIG. 1 the exemplary fixing member 100 can be a fuser roller having a cylindrical substrate 110 with one or more functional layers 120 (also referred to as intermediate layers) and an outer layer 130 formed thereon. In various embodiments, the cylindrical substrate 110 can take the form of a cylindrical tube, e.g., having a hollow structure including a heating lamp therein, or a solid cylindrical shaft. In FIG. 2, the exemplary fixing member 200 can include a belt substrate 210 with one or more functional layers, e.g., 220 and an outer surface 230 formed thereon.

Substrate Layer

The belt substrate 210 and the cylindrical substrate 110 can be formed from, for example, polymeric materials (e.g., polyimide, polyaramide, polyether ether ketone, polyetherimide, polyphthalamide, polyamide-imide, polyketone, polyphenylene sulfide, fluoropolyimides or fluoropolyurethanes) and metal materials (e.g., aluminum or stainless steel) to maintain rigidity and structural integrity as known to one of ordinary skill in the art.

Intermediate Layer

Examples of intermediate or functional layers 120 and 220 include fluorosilicones, silicone rubbers such as room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC® 735 black RTV and SILASTIC® 732 RTV, both from Dow Corning; 106 RTV Silicone Rubber and 90 RTV Silicone Rubber, both from General Electric; and JCR6115CLEAR HTV and SE4705U HTV silicone rubbers from Dow Corning Toray Silicones. Other suitable silicone materials include the siloxanes (such as polydimethylsiloxanes); fluorosilicones such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182. Commercially available LSR rubbers include Dow Corning Q3-6395, Q3-6396, SILASTIC® 590 LSR, SILASTIC® 591 LSR, SILASTIC® 595 LSR, SILASTIC® 596 LSR, and SILASTIC® 598 LSR from Dow Corning. The functional layers provide elasticity and can be mixed with inorganic particles, for example SiC or $Al_2O_3$, as required.

Examples of intermediate or functional layers 120 and 220 also include fluoroelastomers. Fluoroelastomers are from the class of 1) copolymers of two of vinylidenefluoride, hexafluoropropylene, and tetrafluoroethylene; such as those known commercially as VITON A®, 2) terpolymers of vinylidenefluoride, hexafluoropropylene, and tetrafluoroethylene such as those known commercially as VITON B®; and 3) tetrapolymers of vinylidenefluoride, hexafluoropropylene, tetrafluoroethylene, and a cure site monomer, such as those known commercially as VITON GH® or VITON GF®. These fluoroelastomers are known commercially under various designations such as those listed above, along with VITON E®, VITON E 60C®, VITON E430®, VITON 910®, and VITON ETP®. The VITON® designation is a trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a registered trademark of 3M Company. Additional commercially available materials include AFLAS™ a poly(propylene-tetrafluoroethylene), and FLUOREL II (LII900) a poly(propylene-tetrafluoroethylenevinylidenefluoride), both also available from 3M Company, as well as the Tecnoflons identified as FOR-60KIR®, FOR-LHF®, NM® FOR-THF®, FOR-TFS®, TH® NH®, P757® TNS®, T439 PL958®, BR9151® and TN505, available from Ausimont.

The fluoroelastomers VITON GH® and VITON GF® have relatively low amounts of vinylidenefluoride. The VITON GF® and VITON GH® have about 35 weight percent of vinylidenefluoride, about 34 weight percent of hexafluoropropylene, and about 29 weight percent of tetrafluoroethylene, with about 2 weight percent cure site monomer.

For a roller configuration, the thickness of the intermediate or functional layer can be from about 0.5 mm to about 10 mm, or from about 1 mm to about 8 mm, or from about 2 mm to about 7 mm. For a belt configuration, the functional layer can be from about 25 microns up to about 2mm, or from 40 microns to about 1.5 mm, or from 50 microns to about 1 mm.

Release Layer

Disclosed herein is a release layer or surface layer containing a plurality of polyimide particles dispersed in a fluoropolymer.

Additives and additional conductive or non-conductive fillers may be present in the substrate layers 110 and 210, the intermediate layers 220 and 230 and the release layers 130 and 230. In various embodiments, other filler materials or additives including, for example, inorganic particles, can be used for the coating composition and the subsequently formed surface layer. Conductive fillers used herein may include carbon blacks such as carbon black, graphite, fullerene, acetylene black, fluorinated carbon black, and the like; carbon nanotubes; metal oxides and doped metal oxides, such as tin oxide, antimony dioxide, antimony-doped tin oxide, titanium dioxide, indium oxide, zinc oxide, indium oxide, indium-doped tin trioxide, and the like; and mixtures thereof. Certain polymers such as polyanilines, polythiophenes, polyacetylene, poly(p-phenylene vinylene), poly (p-phenylene sulfide), pyrroles, polyindole, polypyrene, polycarbazole, polyazulene, polyazepine, poly(fluorine), polynaphthalene, salts of organic sulfonic acid, esters of phosphoric acid, esters of fatty acids, ammonium or phosphonium salts and mixtures thereof can be used as conductive fillers. In various embodiments, other additives known to one of ordinary skill in the art can also be included to form the disclosed composite materials.

Adhesive Layer

Optionally, any known and available suitable adhesive layer may be positioned between the outer layer or outer surface, the intermediate layer and the substrate. Examples of suitable adhesives include silanes such as amino silanes (such as, for example, HV Primer 10 from Dow Corning), titanates, zirconates, aluminates, and the like, and mixtures thereof. In an embodiment, an adhesive in from about 0.001 percent to about 10 percent solution can be wiped on the substrate. The adhesive layer can be coated on the substrate, or on the intermediate layer, to a thickness of from about 2 nanometers to about 2,000 nanometers, or from about 2 nanometers to about 500 nanometers. The adhesive can be coated by any suitable known technique, including spray coating or wiping.

Figure 3A:
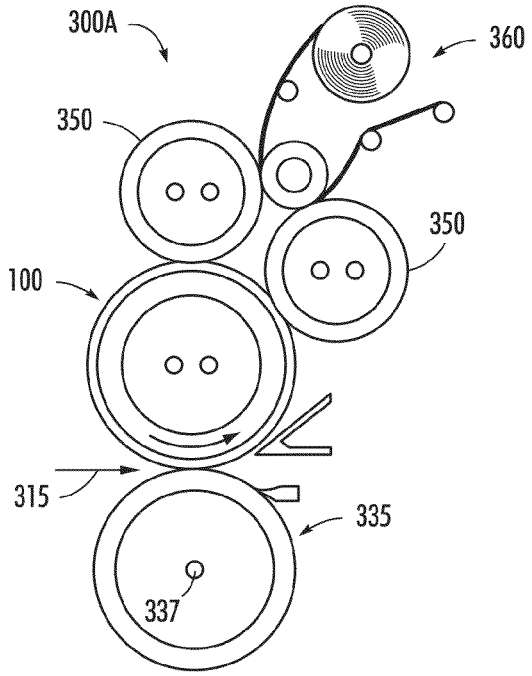
FIGS. 3A-3B depict exemplary fusing configurations using the fuser rollers shown in FIG. 1 in accordance with the present teachings.
Figure 3B:
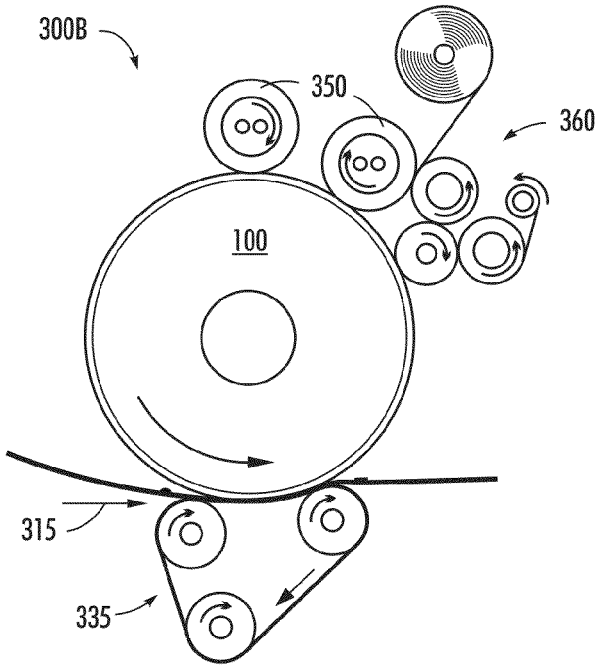
Figure 4A:
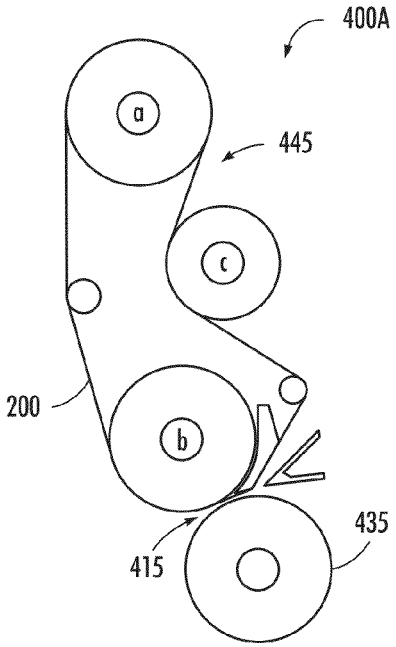
FIGS. 4A-4B depict another exemplary fusing configurations using the fuser belt shown in FIG. 2 in accordance with the present teachings.
Figure 4B:
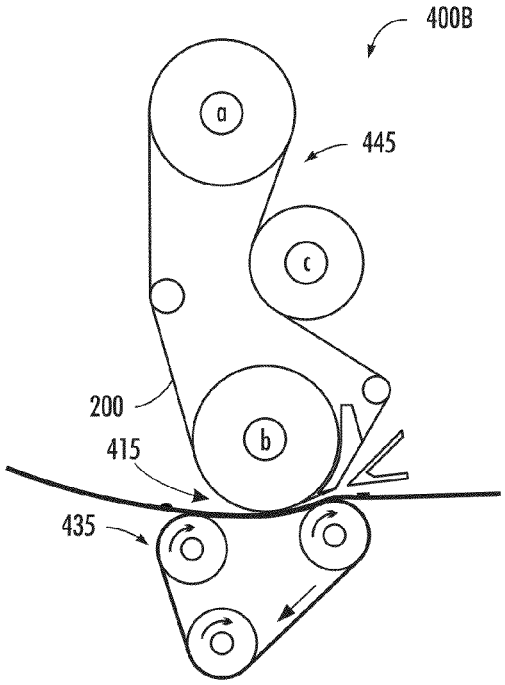

FIGS. 3A-3B and FIGS. 4A-4B depict exemplary fusing configurations for the fusing process in accordance with the present teachings. It should be readily apparent to one of ordinary skill in the art that the fusing configurations 300A-B depicted in FIGS. 3A-3B and the fusing configurations 400A-B depicted in FIGS. 4A-4B represent generalized schematic illustrations and that other members/layers/substrates/configurations can be added or existing members/layers/substrates/configurations can be removed or modified. Although an electrophotographic printer is described herein, the disclosed apparatus and method can be applied to other printing technologies. Examples include offset printing and inkjet and solid transfix machines.

FIGS. 3A-3B depict the fusing configurations 300A-B using a fuser roller shown in FIG. 1 in accordance with the present teachings. The configurations 300A-B can include a fuser roller 100 (i.e., 100 of FIG. 1) that forms a fuser nip with a pressure applying mechanism 335, such as a pressure roller in FIG. 3A or a pressure belt in FIG. 3B, for an image supporting material 315. In various embodiments, the pressure applying mechanism 335 can be used in combination with a heat lamp 337 to provide both the pressure and heat for the fusing process of the toner particles on the image supporting material 315. In addition, the configurations 300A-B can include one or more external heat roller 350 along with, e.g., a cleaning web 360, as shown in FIG. 3A and FIG. 3B.

FIGS. 4A-4B depict fusing configurations 400A-B using a fuser belt shown in FIG. 2 in accordance with the present teachings. The configurations 400A-B can include a fuser belt 200 (i.e., 200 of FIG. 2) that forms a fuser nip with a pressure applying mechanism 435, such as a pressure roller in FIG. 4A or a pressure belt in FIG. 4B, for a media substrate 415. In various embodiments, the pressure applying mechanism 435 can be used in a combination with a heat lamp to provide both the pressure and heat for the fusing process of the toner particles on the media substrate 415. In addition, the configurations 400A-B can include a mechanical system 445 to move the fuser belt 200 and thus fusing the toner particles and forming images on the media substrate 415. The mechanical system 445 can include one or more rollers 445*a-c*, which can also be used as heat rollers when needed.

Figure 5:
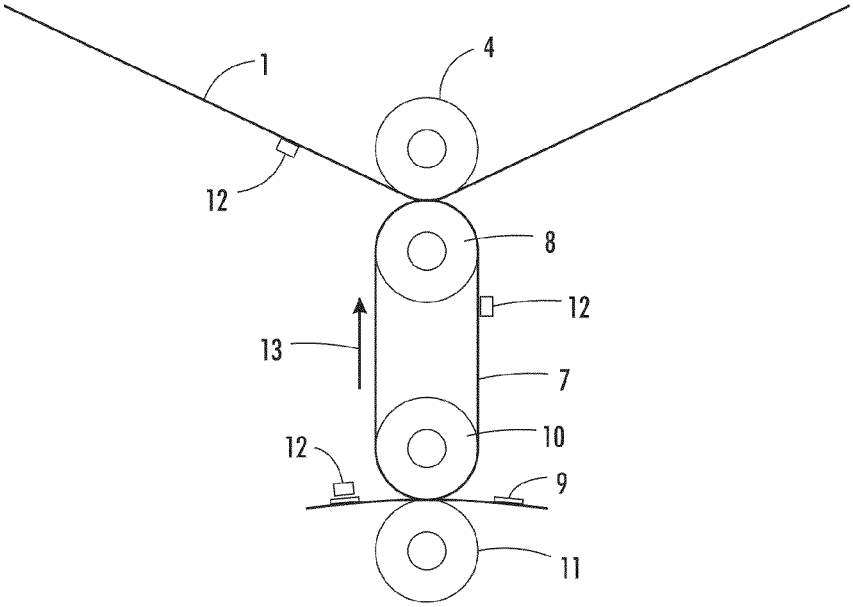
FIG. 5 depicts an exemplary fuser configuration using a transfix apparatus.

FIG. 5 demonstrates a view of an embodiment of a transfix member 7 which may be in the form of a belt, sheet, film, or like form. The transfix member 7 is constructed similarly to the fuser belt 200 described above. The developed image 12 positioned on intermediate transfer member 1 is brought into contact with and transferred to transfix member 7 via rollers 4 and 8. Roller 4 and/or roller 8 may or may not have heat associated therewith. Transfix member 7 proceeds in the direction of arrow 13. The developed image is transferred and fused to a copy substrate 9 as copy substrate 9 is advanced between rollers 10 and 11. Rollers 10 and/or 11 may or may not have heat associated therewith.

Disclosed herein is a fuser member having increased mechanical robustness. The fuser member includes a surface layer or release layer of polyimide particles dispersed in a fluoropolymer. The polyimide particles are prepared through a reactive electrospraying process. Polyimide has excellent thermal, chemical and mechanical stability and the use of a polyimide filler within the fuser topcoat improves wear resistance. The polyimide particles can be used to impart a surface texture which allows for the production of low gloss prints. Print gloss can be adjusted by varying the amount of polyimide particle incorporated into the top coat material.

The polyimide particles are prepared through a reactive electrospraying process. Park et. al. (Journal of Materials Chemistry, 2012, 22, 16005-16010) describes a method for the preparation of polyimide particles through a reactive electrospraying technique. The process involves the electrospraying of a poly(amic acid) solution into heated silicone oil which allows for the in-situ imidization to occur to produce polyimide particles with controlled surface morphology.

The polyimide particles are represented by the following structure

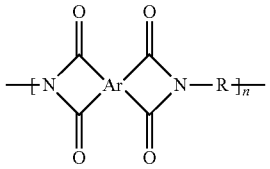

wherein Ar represents an aromatic group, R represents a aromatic or aliphatic hydrocarbon group and n is from about 20 to about 1000. In embodiments n is from about 30 to about 900 or from about 40 to about 800.

The electrospraying process with in situ imidization forms polyimide particles with controlled surface morphologies. A polyamic acid (PAA) solution is pumped through a nozzle in which a high voltage is applied. The PAA is dissolved in an organic solvent. An electrically charged jet of PAA droplets is formed. The electrostatically charged droplets of PAA are sprayed into silicone oil that is at an elevated temperature (approximately 200° C.). The morphology is controlled through operating parameters described below.

The surface of the polyimide particles has dimples. The polyimide particles under magnification have a surface that looks similar to a golf ball. These dimples were formed only on the surface of the particles. The droplet size was controlled under various operating factors, such as the flow rate, the concentration of polymer solution and the electric field to provide polyimide particles having a particle size of from about 0.01 μm to about 50 μm, or in embodiments a particles size of from about 0.1 μm to about 5 μm, or from about 0.5 μm to about 1 μm. The polyimide particles have textured surface characterized by nano-sized dimples and protrusions. The nano-sized dimples have a roughness ranging from 5 to 500 nm in a scan area of about 1×1 square micrometers. The amount of polyimide particles provided in the release layer is from about 0.5 weight percent to about 50 weight percent, or in embodiments from about 1 weight percent to about 20 weight percent or from about 5 weight percent to about 10 weight percent.

The release layer comprises a surface energy of 17 mN/m or less. The release layer has a water contact angle of 120° or larger, or in embodiments from about 120° to 170°, from about 130° to about 160°, and from 140° to 150°

Figure 6:
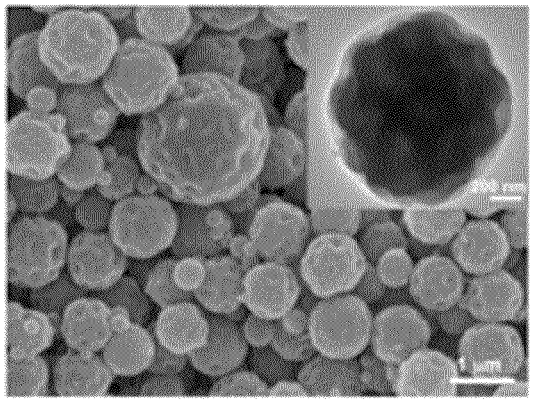
FIG. 6 shows SEM images of polyimide particles.

The dimples on the surface of the polyimide particles allow for additives (such as silicone oil) to cling to or adhere to the surface. Examples of low surface energy materials include; fluoroplastics particles such as PTFE, PFA and FEP particles; siloxane-containing polymers such as PDMS, functionalized PDMS; fluorosilicone; perfluoropolyethers; fluorocarbon; and a mixtures thereof. The polyimide particles can be modified with such additives to increase the hydrophobicity of the surface layer or lower the surface energy of the surface layer. Shown in FIG. 6 are images of polyimide particles having dimples on the surface.

The polyimide particles can be dispersed in a polymeric binder to create the fuser topcoat or the particles can be sprayed onto the fuser member and the fluoroelastomer can be coated around the polyimide particles.

Fluoropolymers suitable for use in the formulation described herein include fluoroplastics comprising a monomeric repeat unit that is selected from the group consisting of vinylidene fluoride, hexafluoropropylene, tetrafluoroethylene, perfluoroalkylvinylether, and mixtures thereof. Examples of fluoroplastics include polytetrafluoroethylene (PTFE); perfluoroalkoxy polymer resin (PFA); and copolymer of tetrafluoroethylene (TFE) and hexafluoropropylene (HFP), and mixtures thereof. The fluoroplastic provides chemical and thermal stability and has a low surface energy. The fluoroplastic has a melting temperature of from about 280° C. to about 400° C. or from about 290° C. to about 390° C. or from about 300° C. to about 380° C.

Fluoropolymers suitable for use in the formulation described herein include fluoroelastomers suitable for use in the formulation described are from the class of 1) copolymers of two of vinylidenefluoride, hexafluoropropylene, and tetrafluoroethylene; such as those known commercially as VITON A®, 2) terpolymers of vinylidenefluoride, hexafluoropropylene, and tetrafluoroethylene such as those known commercially as VITON B®; and 3) tetrapolymers of vinylidenefluoride, hexafluoropropylene, tetrafluoroethylene, and a cure site monomer, such as those known commercially as VITON GH® or VITON GF®. These fluoroelastomers are known commercially under various designations such as those listed above, along with VITON E®, VITON E 60C®, VITON E430®, VITON 910®, and VITON ETP®. The VITON® designation is a trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a registered trademark of 3M Company. Additional commercially available materials include AFLAS™ a poly(propylene-tetrafluoroethylene), and FLUOREL II (LII900) a poly(propylene-tetrafluoroethylenevinylidenefluoride), both also available from 3M Company, as well as the Tecnoflons identified as FOR-60KIR®, FOR-LHF®, NM® FOR-THF®, FOR-TFS®, TH®, NH®, P757®, TNS®, T439®, PL958®, BR9151® and TN505®, available from Ausimont.

The fluoroelastomers VITON GH® and VITON GF® have relatively low amounts of vinylidenefluoride. The VITON GF® and VITON GH® have about 35 weight percent of vinylidenefluoride, about 34 weight percent of hexafluoropropylene, and about 29 weight percent of tetrafluoroethylene, with about 2 weight percent cure site monomer. The fluoroelastomers are cured at a temperature of from about 80° C. to about 250° C.

To improve the wettability between polyimide particles and fluoropolymer particles, a fluorinated surfactant GF300 or 400 (commercially available from Toagosei) is added as a wetting agent. GF-300 and GF-400 are methacrylate-based fluorosurfactant referred to as fluorinated graft copolymers. Others fluorinated surfactants include GF-150 from Toagosei Chemical Industries; MODIPER F-600 from Nippon Oil & Fats Company; SURFLON S-381 and S-382 from Asahi Glass Company; FC-430, FC-4430, FC-4432 and FC-129 from 3M. The amount in the powder is from about 0.1 weight percent to about 5 weight percent, or from about 0.5 weight percent to about 3.0 weight percent, or from about 1.0 weight percent to about 2.0 weight percent based on the total weight surface layer.

The coating composition for the release layer is prepared by shear-mixing the polyimide particles and fluoropolymer particles, for example, THVP210 from Dyneon in a suitable solvent. Solvents suitable for dispersing the polyimide particles and fluoropolymer include water; alcohols such as methanol, ethanol, or isopropanol; a ketone such as acetone, methyl ethyl ketone (MEK),methyl isobutylketone (MIBK), or other suitable solvent.

In various embodiments, the coating composition of polyimide particles, fluoropolymer particles, solvent and an optional surfactant can be coated using, for example, coating techniques, extrusion techniques and/or molding techniques. As used herein, the term "coating technique" refers to a technique or a process for applying, forming, or depositing a dispersion on a surface. Therefore, the term "coating" or "coating technique" is not particularly limited in the present teachings, and dip coating, painting, brush coating, roller coating, pad application, spray coating, spin coating, casting, or flow coating can be employed.

After coating, the composition is heated to a temperature for a time sufficient to melt or cure the fluoropolymer to form the coated layer. Fluoroplastics have a melting temperature of from about 280° C. to about 400° C. or from about 290° C. to about 390° C. or from about 300° C. to about 380° C. and are heated for a time of from about 1 minutes to about 30 minutes, or a time of from about 2 minutes to about 25 minutes, or a time of from about 3 minutes to about 20 minutes. Fluoroelastomers are cured at a temperature of from about 80° C. to about 250° C. for a time of from about 1 minutes to about 30 minutes, or a time of from about 2 minutes to about 25 minutes, or a time of from about 3 minutes to about 20 minutes.

Specific embodiments will now be described in detail. These examples are intended to be illustrative, and not limited to the materials, conditions, or process parameters set forth in these embodiments. All parts are percentages by solid weight unless otherwise indicated.

EXAMPLES

A composite fuser topcoat was prepared as described below.

A mixture containing about 30 weight percent of PFA powder (MP320, available from E. I. du Pont de Nemours, Inc.) and 10 weight percent of the polyimide (PI) particle were dispersed in MEK solvent and sonicated multiple times to form a dispersion. A separate MEK solution containing about 10 weight percent of a poly(propylene carbonate) (PPC) with a molecular weight of 265,000 g/mol (QPAC® 40, available from Empower Materials) was added to the PFA/PI dispersion to form a stable coating dispersion containing 10 weight percent poly(propylene carbonate). The stable coating dispersion was applied by flow coating onto a silicone roll (Olympia roll) having a clear primer. The roll was baked for 30 minutes at 250° C. to remove the poly(propylene carbonate), followed by further baking for 8 minutes at 350° C. to melt the PFA and form a fuser roll with approx. 40 μm-thick PFA topcoat with polyimide particles imbedded. Low gloss prints were produced by the fuser roll described in an oil-less fusing system.

It will be appreciated that variants of the above-disclosed and other features and functions or alternatives thereof may be combined into other different systems or applications. Various presently unforeseen or unanticipated alternatives, modifications, variations, or improvements therein may be subsequently made by those skilled in the art, which are also encompassed by the following claims.

What is claimed is:

1. A fuser member, comprising:

a substrate, and a release layer disposed on the substrate comprising a plurality of polyimide particles dispersed in a fluoropolymer, wherein the plurality of polyimide particles have a textured surface comprising nano-sized dimples having a roughness of from about 5 to about 500 nm in a scan area of about 1×1 square micrometers.

2. The fuser member of claim 1, wherein the fluoropolymer comprises a fluoroplastic selected from the group consisting of: polytetrafluoroethylene (PTFE);

perfluoroalkoxy polymer resin (PFA); copolymers of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP) and a cure site monomer.

3. The fuser member of claim 1, wherein the fluoropolymer comprises a fluoroelastomer selected from the group consisting of: 1) copolymers of two of vinylidenefluoride, hexafluoropropylene, and tetrafluoroethylene; 2) terpolymers of vinylidenefluoride, hexafluoropropylene, and tetrafluoroethylene; and 3) tetrapolymers of vinylidenefluoride, hexafluoropropylene, tetrafluoroethylene, and a cure site monomer.

4. The fuser member of claim 1, wherein the plurality of polyimide particles have a size of from about 0.01 microns to about 50 microns.

5. The fuser member of claim 1, wherein the plurality of polyimide particles are present in an amount of about 0.5 percent to about 30 percent based on a weight of the release layer.

6. The fuser member of claim 1, wherein the release layer further comprises filler materials selected from the group consisting of carbon black, graphite, fullerene, acetylene black, fluorinated carbon black, carbon nanotubes; metal oxides,doped metal oxides, polyanilines, polythiophenes, polyacetylene, poly(p-phenylene vinylene), poly(p-phenylene sulfide), pyrroles, polyindole, polypyrene, polycarbazole, polyazulene, polyazepine, poly(fluorine), polynaphthalene, salts of organic sulfonic acid, esters of phosphoric acid, esters of fatty acids, ammonium salts and phosphonium salts.

7. The fuser member of claim 1, wherein the release layer comprises a thickness of from about 10 micrometers to about 250 micrometers.

8. The fuser member of claim 1, wherein the release layer comprises a surface energy of 17 mN/m or less.

9. The fuser member of claim 1, wherein the release layer comprises a water contact angle of 120° or greater.

10. The fuser member of claim 1, further comprising an intermediate layer disposed between the substrate and the release layer.

11. The fuser member of claim 10, wherein the intermediate layer comprises a silicone material.

12. The fuser member according to claim 1, wherein the polyimide particles comprise:

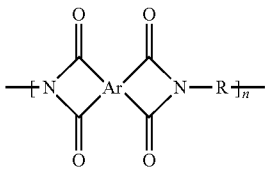

wherein Ar represents an aromatic group, R represents an aromatic or aliphatic hydrocarbon group and n is from about 20 to about 1000.

13. An image forming apparatus for forming images on a recording medium, the apparatus comprising a charge-retentive surface to receive an electrostatic latent image thereon; a development component to apply toner to the charge-retentive surface to develop the electrostatic latent image to form a developed image on the charge-retentive surface; a transfer component to transfer the developed image from the charge retentive surface to a copy substrate; and a fuser member for fusing toner images to a surface of the copy substrate, wherein said fuser member comprises a substrate and disposed thereon, an outer layer comprising a plurality polyimide particles dispersed in a fluoropolymer, wherein the plurality of polyimide particles have a textured surface comprising nano-sized dimples having a roughness of from about 5 to about 500 nm in a scan area of about 1×1 square micrometers.

14. The image forming apparatus of claim 13, wherein the plurality of polyimide particles have a size of from about 0.01 microns to about 50 microns.

15. The image forming apparatus of claim 13, wherein the plurality of polyimide particles are present in an amount of about 0.5 percent to about 50 percent based on a weight of the release layer.

16. A fuser member, comprising:

a substrate, an intermediate layer disposed on the substrate comprising a material selected from the group consisting of fluoroelastomers and silicone; and a release layer disposed on the intermediate layer comprising a plurality polyimide particles dispersed in a fluoropolymer wherein the plurality of polyimide particles have a size of from about 0.01 microns to about 50 microns, wherein the polyimide particles comprise:

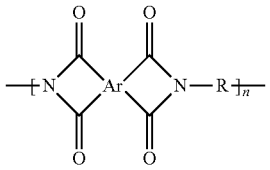

wherein Ar represents an aromatic group, R represents an aromatic or aliphatic hydrocarbon group and n is from about 20 to about 1000.

17. The fuser member according to claim 16, wherein the plurality of polyimide particles have a textured surface comprising nano-sized dimples having a roughness of from about 5 to about 500 nm in a scan area of about 1×1 square micrometers.

* * * * *